US005442840A

United States Patent [19]

Ewald

[11] Patent Number: 5,442,840

[45] Date of Patent: Aug. 22, 1995

[54] SEATBELT BUCKLE SAFETY SHEATH

[76] Inventor: Craig B. Ewald, R.R. 1, Box 17A, Buda, Ill. 61314

[21] Appl. No.: 393

[22] Filed: Jan. 4, 1993

[51] Int. Cl.[6] ..... A44B 11/26

[52] U.S. Cl. ..... 24/633; 24/573.1

[58] Field of Search ..... 24/633, 573.1, 636, 24/637, 638, 639, 640, 641, 642

[56] References Cited

U.S. PATENT DOCUMENTS

| | | | |
|---|---|---|---|
| 4,497,094 | 2/1985 | Morris | 24/633 |
| 4,624,033 | 11/1986 | Orton | 24/573.1 |
| 4,674,303 | 6/1987 | Salcone, II | 24/633 |
| 4,675,954 | 6/1987 | Gullickson | 24/573.1 |
| 4,731,912 | 3/1988 | Boriskie et al. | 24/633 |
| 4,939,824 | 7/1990 | Reed | 24/633 |
| 4,961,251 | 10/1990 | Smith | 24/633 |
| 4,987,662 | 1/1991 | Haffey et al. | 24/633 |
| 5,129,129 | 7/1992 | Collins et al. | 24/573.1 |
| 5,189,767 | 3/1993 | Reitsma | 24/633 |

FOREIGN PATENT DOCUMENTS

| | | | |
|---|---|---|---|
| WO84/1275 | 4/1984 | WIPO | 24/633 |

*Primary Examiner*—Richard A. Bertsch
*Assistant Examiner*—Roland G. McAndrews, Jr.
*Attorney, Agent, or Firm*—Rockey, Rifkin & Ryther

[57] ABSTRACT

A seatbelt buckle safety sheath to prevent the inadvertent releasing of the seatbelt buckle by young children. Specifically, the seatbelt buckle safety sheath is made of a resilient material and frictionally encompasses the female portion of the seatbelt buckle. The resilient material of the safety sheath imposes a compressive force substantially greater than the normal force required to release the seatbelt buckle from a fastened condition. Thus, an adult can compress the resilient material to activate the seatbelt buckle release button, while a child will be prevented from accomplishing same.

4 Claims, 1 Drawing Sheet

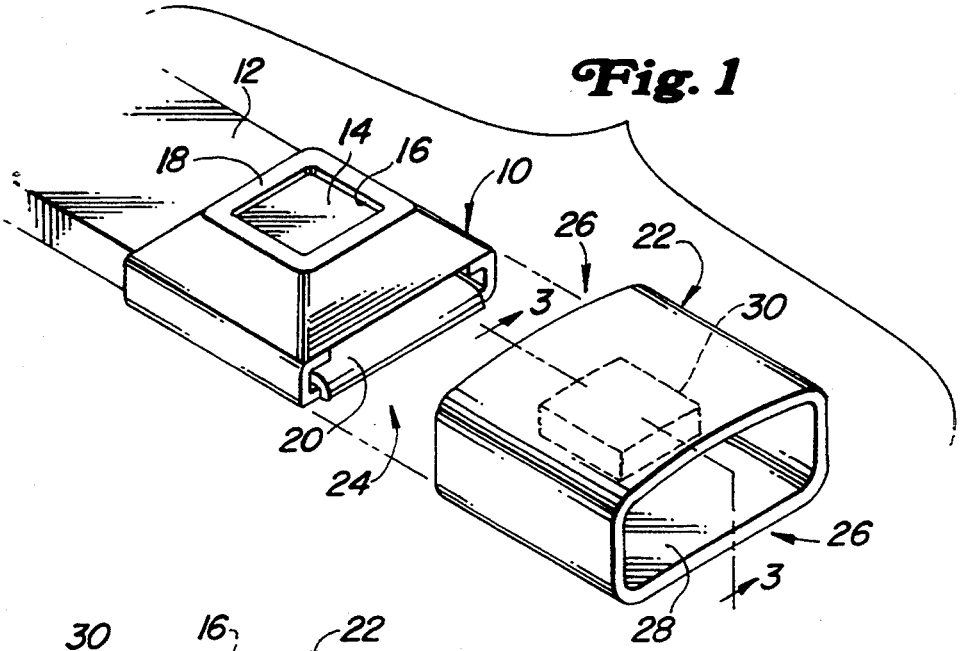
Fig. 1
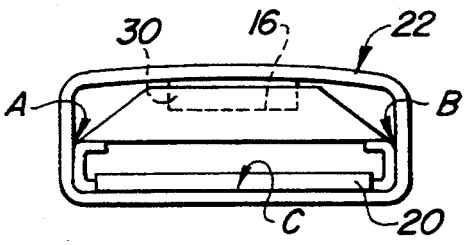
Fig. 2
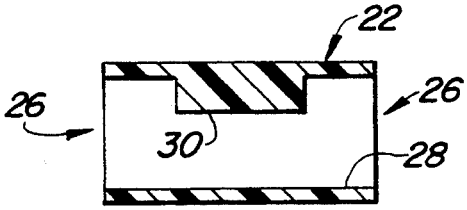
Fig. 3
Fig. 5
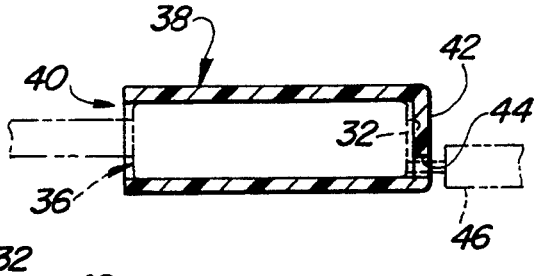
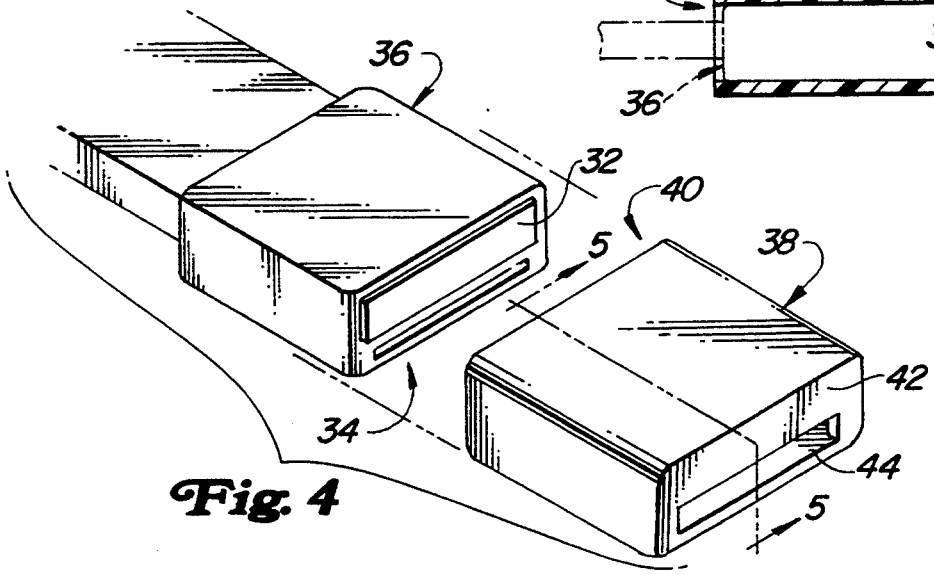
Fig. 4

SEATBELT BUCKLE SAFETY SHEATH

BACKGROUND OF THE INVENTION

1. Field of the Invention

The present invention relates to devices for preventing the inadvertent releasing of a fastened seatbelt and, more specifically, for preventing young children from activating the seatbelt release button.

Automotive seatbelt restraint systems typically consist of at least two separable straps, fastenable to one another by means of an actuable buckle. The actuable buckle has a female first portion, separable from a male second portion by depressing a release button. Each portion fastened to a free end of one strap. By design, the release button is an integral part of the female first portion and is spring biased to a fastened condition automatically when the male second portion is inserted. The release button is exposed to accommodate the unfastening of the seatbelt. Recently, some automotive seatbelt restraint systems are provided with the release button located on the end of the female portion instead of located on the top.

The end design presents unique design criteria for which a seatbelt buckle safety sheath has not been addressed.

It has been desirable for many years to prevent young children from unfastening themselves from a seatbelt. Many devices have been disclosed to accommodate this desire while allowing adults to have a normal function of the seatbelt. Some such devices, as disclosed in U.S. Pat. No. 4,502,194 (Morris) teach of a sleeve encompassing the female portion, having and opening positioned over the release button through which a tool can be inserted to depress the release button. Another embodiment, disclosed, teaches of a cap to be removed for access to the release button. U.S. Pat. No. 4,731,917 (Boriskie et al) discloses a box-like structure encompassing the female portion of the seatbelt which has to be opened to expose the release button. U.S. Pat. No. 4,624,033 (Orton) teaches the use of a "sufficiently stiff material" which can be deflected to actuate the release button. In this embodiment, "spring finger" elements secure the structure to the seatbelt buckle. In yet another version of a deformable surface, U.S. Pat. No. 4,939,824 (Reed) uses velcro to retain the structure to the seatbelt buckle. U.S. Pat. No. 4,675,954 (Gullickson) teaches of a sleeve fitted over the female portion of the seatbelt buckle having a slot in one end to receive the male portion of the seatbelt buckle, thus, "trapping" the protective structure between the two belts. Although these aforementioned patents and other patents in the related art may fulfill the criteria of preventing young children from releasing a fastened seatbelt, the use of tools, hinged doors, limited access openings and the like, limit their use in actual practice.

In all the prior art, no one has addressed a means for providing a "child-proof" seatbelt buckle when the release button is located on the end of the female portion of the buckle where the male portion of the seatbelt is inserted.

SUMMARY OF THE INVENTION

Accordingly, it is an object of the present invention to utilize a seatbelt buckle sheath which is manufactured of a resilient material and frictionally encompasses the female portion of a seatbelt buckle without the use of additional elements to secure the sheath to the buckle.

Further objects of the invention are to provide a sheath for use on seatbelt buckles with release buttons located on the top on the end of the female portion; to provide a sheath which does not require the use of "tools"; to reduce the manufacturing costs of such sheaths; to provide a sheath which will not easily be misplaced; and prevent young children from unfastening the seatbelt buckle.

In accordance with the aforementioned objects, the present invention provides a seatbelt buckle safety sheath, manufactured of a resilient material, which frictionally encompasses the female portion of the seatbelt buckle, protecting the release button from inadvertent actuation. The female portion of the seatbelt buckle consists of a housing enclosing a spring biased release button and a slot for which the male portion of seatbelt buckle can be received. Upon insertion of the male portion, the seatbelt buckle will automatically latch. To release the fastened seatbelt, the release button is depressed. The seatbelt buckle sheath encompasses the release button to prevent young children from unfastening the seatbelt by requiring a force greater than a child can apply.

In another embodiment, the seatbelt buckle safety sheath is shown encompassing a seatbelt buckle having the release button exposed on the end of said buckle.

BRIEF DESCRIPTION OF THE DRAWINGS

A more complete understanding of the invention may be obtained from the detailed description that follows, taken with the accompanying drawing of the embodiment in which:

FIG. 1 Is an exploded isometric view of a first embodiment of the seatbelt buckle safety sheath according to the present invention.

FIG. 2 Is end view of the present invention, shown encompassing the female portion of the seatbelt buckle.

FIG. 3 Is a cross-sectional view of the present invention taken along line 3—3 of FIG. 1.

FIG. 4 Is an exploded isometric view of a second embodiment of the seatbelt buckle safety sheath.

FIG. 5 Is a cross-sectional view of the second embodiment taken along line 5—5 of FIG. 4.

DETAILED DESCRIPTION OF THE PREFERRED EMBODIMENT

In the following detailed description, references will be made to the female portion of the seatbelt buckle since the release button is designed to be an integral portion of this half. It should be realized that the fastening of the seatbelt can only be obtained by the insertion of the male portion of the seatbelt buckle into the female portion of the seatbelt buckle.

Referring to FIG. 1, a female portion of a seatbelt buckle 10 is shown being fastened to a strap 12. The seatbelt buckle 10 consists of a design which a release button 14 is externally exposed via an aperture 16 formed in top surface 18 of the seatbelt buckle 10. The release button 14 is biased in an upward position towards the top surface 18 by means as best described by U.S. Pat. No. 4,624,033 (Orton). The seatbelt buckle 10 is provided with a slot 20, which receives a male portion (not shown). Fastening of the seatbelt buckle is obtained when the male portion is in positive engagement with the female portion 10. This is usually determined by a firm tug on the strap 12 after a "click" is audible. To unfasten the seatbelt buckle, the release button 14 is depressed, overcoming the compression force of the latch spring (not shown). The compression force required to unfasten the seatbelt can be easily applied by a young child. To prevent the seatbelt buckle from being inadvertently unfastened, a safety sheath 22 is slipped over the receiving end 24 of the female portion 10. The safety sheath 22 is manufactured of an elastomeric material (such as plastic) and generally formed in a tubular rectangular cross-section so as to accommodate the rectangular configuration of female seatbelt buckles. The safety sheath 22 is provided with open ends 26, best shown in FIG. 3, allowing the safety sheath to encompass the female portion of the seatbelt buckle 10. The interior surface 28 of the safety sheath 22 is provided with a thickened portion 30 generally having a rectangular shape similar to the release button 14. When the safety sheath 22 is slipped over the receiving end 24 of the female portion of the seatbelt buckle 10, the thickened portion 30 is received within the aperture 16 fitting and positioning the safety sheath 22 to the female portion 10. As best shown in FIG. 2, the safety sheath 22 will deform when the thickened portion 30 is properly seated in the aperture 16. The deformation of the safety sheath 22 provides frictional contact with the female portion 10 at locations A, B, and C.

The area of the safety sheath located over the release button 14 provides a stiffened resilience to the normal operation of the release button 14. Thus, a greater force than normal, not capable of being applied by a young child, is required to unfasten the seatbelt.

Referring to FIGS. 4 and 5, a second embodiment is shown. In these embodiments, a release button 32 is provided in the receiving end 34 of the female portion of the seatbelt buckle 36. To provide this design with similar protection, a safety sheath 38, as previously described, frictionally encompasses the seatbelt buckle 36. The safety sheath 38 is again manufactured of a deformable material (such as plastic) and generally of a rectangular design. The safety sheath 38 has an open end 40 in which the seatbelt buckle 36 is received. An abutting wall 42 is provided opposite the open end 40 and covers the release button 32. The abutting wall 42 has a slot 44 to allow the insertion of a male portion 46 (see FIG. 5). Again, the internal operation of the female portion 36 is well-known in the art and depressing the release button 32, unfastens the seatbelt buckle. With the safety sheath 38 encompassing the female portion 36, the abutting wall 42 provides a stiffened resilience requiring greater force to actuate the release button 32.

Various other features of the present invention, not specifically enumerated herein, will undoubtedly occur to those versed in the art, as will other modifications and alterations in the embodiments of the invention illustrated; all of which may be achieved without departing from the spirit and scope of the invention as defined in the appended claims.

What is claimed:

1. A child safety seatbelt securement device for use with seatbelt locking mechanisms comprising:

a) a male seatbelt buckle;

b) a female seatbelt buckle, including means for securing said male seatbelt buckle in said female seatbelt buckle;

c) means in said female seatbelt buckle for releasing said male seatbelt buckle from said female seatbelt buckle;

d) a deformable housing having interior and exterior surfaces for encompassing said female seatbelt buckle;

e) said female seatbelt buckle inserted into said deformable housing deforming said housing whereby said housing encompasses said female seatbelt buckle;

f) said female seatbelt buckle restrained in a fixed position in said housing by the forces said of housing against said female seatbelt buckle; and g) said housing deformed by said female seatbelt buckle having at least one interior surface in close proximity to said release mechanism whereby pressure on the exterior surface of said housing in close proximity to said release mechanism actuates said release mechanism.

2. A child safety seatbelt securement device as claimed in claim 1, wherein said deformable housing has a first open end for the insertion of said female seatbelt buckle and a second end opposite said first end at least partially opened for the insertion of the male seatbelt buckle.

3. A child safety seatbelt securement device as claimed in claim 2, wherein said female seatbelt buckle is in contact with at least three surfaces of said housing and one surface in close proximity to the surface of the female seatbelt buckle containing said release mechanism.

4. A child safety seatbelt securement device as claimed in claim 3, wherein said interior configuration of said deformable housing, including the interior surface adjacent to the surface of said female seatbelt buckle containing the said release mechanism is a mirror image of said female seatbelt buckle.

* * * * *